US011786929B2

(12) United States Patent
Jang

(10) Patent No.: US 11,786,929 B2
(45) Date of Patent: Oct. 17, 2023

(54) SPRAY COATER AND THIN-FILM TRANSISTOR MANUFACTURED USING THE SAME

(71) Applicant: ADRC. CO. KR, Seoul (KR)

(72) Inventor: Jin Jang, Seoul (KR)

(73) Assignee: ADRC. CO. KR, Seoul (KR)

( * ) Notice: Subject to any disclaimer, the term of this patent is extended or adjusted under 35 U.S.C. 154(b) by 0 days.

(21) Appl. No.: 17/691,256

(22) Filed: Mar. 10, 2022

(65) Prior Publication Data

US 2022/0371044 A1 Nov. 24, 2022

(30) Foreign Application Priority Data

May 24, 2021 (KR) ..... 10-2021-0066425

(51) Int. Cl.

| | |
|---|---|
| ***B05C 13/02*** | (2006.01) |
| ***B05C 5/02*** | (2006.01) |
| ***B05C 9/14*** | (2006.01) |
| ***B05B 16/20*** | (2018.01) |

(52) U.S. Cl.

CPC ..... *B05C 13/02* (2013.01); *B05B 16/20* (2018.02); *B05C 5/0208* (2013.01); *B05C 9/14* (2013.01)

(58) Field of Classification Search

None

See application file for complete search history.

(56) References Cited

U.S. PATENT DOCUMENTS 4,498,414 A * 2/1985 Kiba ..... B25J 9/0093 118/500
5,374,312 A * 12/1994 Hasebe ..... B05C 5/027 118/694
5,565,034 A * 10/1996 Nanbu ..... H01L 21/67265 118/712
7,694,647 B2 * 4/2010 Ishikawa ..... H01L 21/67109 417/217
8,146,530 B2 * 4/2012 Ishikawa ..... H01L 21/67178 414/217
8,176,870 B2 * 5/2012 Ikushima ..... H01L 51/0004 118/305
8,181,596 B2 * 5/2012 Ishikawa ..... H01L 21/6831 414/217
8,215,262 B2 * 7/2012 Ishikawa ..... G03F 7/40 414/217

(Continued)

*Primary Examiner* — Jethro M. Pence

(74) *Attorney, Agent, or Firm* — LEX IP MEISTER, PLLC

(57) ABSTRACT

The present disclosure provides a spray coater including a spray nozzle unit having at least one spray nozzle and configured to spray a coating material, a spray nozzle transfer unit configured to control a position of the spray nozzle unit by operating a transfer block, on which the spray nozzle unit is mounted, at least in a planar direction, a substrate seating unit positioned below the spray nozzle unit and configured such that a substrate, which is subjected to coating, is seated thereon, a substrate carrier configured to accommodate the substrate before the substrate is coated and accommodate the substrate after the substrate is coated, and a robot arm configured to unload the substrate from the substrate carrier and provide the substrate to the substrate seating unit before the substrate is coated or unload the substrate from the substrate seating unit and load the substrate on the substrate carrier after the substrate is coated.

21 Claims, 13 Drawing Sheets

(56) References Cited

U.S. PATENT DOCUMENTS

| | | | | |
|---|---|---|---|---|
| 8,550,031 | B2 * | 10/2013 | Ishikawa | H01L 21/67109 414/217 |
| 8,802,488 | B2 * | 8/2014 | Yi | C23C 14/566 156/345.31 |
| 9,508,567 | B2 * | 11/2016 | Namba | H01L 21/68735 |
| 9,721,813 | B2 * | 8/2017 | Ogata | B08B 13/00 |
| 10,105,725 | B2 * | 10/2018 | Tomuta | B05C 5/0216 |
| 10,730,103 | B2 * | 8/2020 | Hosek | B05C 5/001 |
| 10,969,700 | B2 * | 4/2021 | Park | G03F 7/3021 |
| 10,991,601 | B2 * | 4/2021 | Park | H01L 21/67023 |
| 11,260,412 | B2 * | 3/2022 | Tomuta | B05B 13/0431 |
| 11,325,143 | B2 * | 5/2022 | Brochier | B05B 7/1472 |
| 11,380,560 | B2 * | 7/2022 | Lee | H01L 21/67748 |
| 11,456,564 | B2 * | 9/2022 | Ikushima | H01R 13/502 |
| 11,469,105 | B2 * | 10/2022 | Sano | H01L 21/324 |
| 2012/0320361 | A1 * | 12/2012 | Ishikawa | H01L 21/67748 355/72 |
| 2016/0035601 | A1 * | 2/2016 | Eum | H01L 21/67178 432/9 |
| 2020/0026205 | A1 * | 1/2020 | Park | H01L 21/67173 |
| 2021/0057239 | A1 * | 2/2021 | Kim | H01L 21/6719 |
| 2022/0075270 | A1 * | 3/2022 | Kim | G03F 7/70933 |
| 2022/0100096 | A1 * | 3/2022 | Kim | H01L 21/6719 |
| 2022/0102169 | A1 * | 3/2022 | Kim | H01L 21/67178 |

* cited by examiner

SPRAY COATER AND THIN-FILM TRANSISTOR MANUFACTURED USING THE SAME

CROSS-REFERENCE TO RELATED APPLICATION

This application claims priority to and the benefit of Korean Patent Application No. 10-2021-0066425 filed in the Korean Intellectual Property Office on May 24, 2021, the entire contents of which are incorporated herein by reference.

BACKGROUND OF THE INVENTION

(a) Field of the Invention

The present disclosure relates to a spray coater for forming a thin film by using a spray coating method and a thin-film transistor manufactured by using the same.

(b) Description of the Related Art

A spray coater refers to an apparatus for performing a coating process using a spray and is equipped with a system configured to convert a coating liquid into mist in the form of fog and apply the mist onto a surface of a target substrate. As the spray coater system is advanced and diversified, the spray coater system may be used for various purposes such as a process of coating a single sheet of thin film such as a transparent conductive film for a touch panel and a process of applying a photoresist onto a semiconductor or a member for a solar cell.

The spray coater system is economical because the spray coater system may adjust a desired thickness even though the spray coater system sprays a small amount of coating liquid. The spray coater system is characterized by being capable of applying the coating liquid with a uniform thickness onto a surface of a substrate having a level difference, unevenness, and a curved portion, easily forming a thin film on quadrangular and polygonal substrate, and performing a coating process even on a cylindrical substrate.

However, a process of loading and unloading a target substrate is manually performed, which causes a problem in that a working speed is low or precise control cannot be performed. In addition, there is a problem in that it is necessary to set different chamber environments having different process conditions and use different types of materials in order to sequentially form a plurality of films, which is made of different materials, on a target substrate.

The above information disclosed in this Background section is only for enhancement of understanding of the background of the invention, and therefore it may contain information that does not form the prior art that is already known in this country to a person of ordinary skill in the art.

SUMMARY OF THE INVENTION

The present disclosure has been made in an effort to provide a spray coater which may load and unload a target substrate by using an automatic control method and be suitable for sequentially forming a plurality of films using a plurality of materials.

However, the object to be achieved by the embodiments of the present invention is not limited to the above-mentioned object but may be variously expanded without departing from the technical spirit of the present invention.

An exemplary embodiment of the present invention provides a spray coater including a spray nozzle unit having at least one spray nozzle and configured to spray a coating material, a spray nozzle transfer unit configured to control a position of the spray nozzle unit by operating a transfer block, on which the spray nozzle unit is mounted, at least in a planar direction, a substrate seating unit positioned below the spray nozzle unit and configured such that a substrate, which is subjected to coating, is seated thereon, a substrate carrier configured to accommodate the substrate before the substrate is coated and accommodate the substrate after the substrate is coated, and a robot arm configured to unload the substrate from the substrate carrier and provide the substrate to the substrate seating unit before the substrate is coated or unload the substrate from the substrate seating unit and load the substrate on the substrate carrier after the substrate is coated.

The substrate seating unit may further include: a vertical movement holder configured to move the substrate in a vertical direction while moving upward or downward; and a support plate configured to support a lower part of the substrate.

The vertical movement holder may include: a holder body configured to move at least in the vertical direction below the spray nozzle unit; and a pair of holder arms extending from the holder body and configured to seat the substrate on the support plate or move the substrate upward.

The holder arm may extend in a direction parallel to an edge of the support plate.

The holder arm may include: a lower part support portion configured to support the lower part of the substrate; and a lateral part support portion configured to support a lateral part of the substrate.

The pair of holder arms may include a pair of lower part support portions, and a distance between the pair of lower part support portions may be larger than a horizontal width of the support plate.

The spray coater may further include a heating plate further including a temperature control means.

The heating plate may be configured to maintain a temperature of the substrate within a range of 300 to 500° C.

The robot arm may include a horizontal articulated robot.

The spray coater may include: a spray chamber configured to accommodate the spray nozzle unit, the spray nozzle transfer unit, and the substrate seating unit; and a load-lock chamber configured to accommodate the robot arm, in which the spray chamber and the load-lock chamber communicate with each other through a chamber gate which is openable and closable.

The load-lock chamber may be configured to accommodate the substrate carrier.

The spray chamber may include a plurality of sub-spray chambers disposed adjacent to one another and closed from one another, and each of the plurality of sub-spray chambers may be configured to accommodate the spray nozzle unit, the spray nozzle transfer unit, and the substrate seating unit.

Each of the plurality of sub-spray chambers may communicate with the load-lock chamber through a chamber gate which is openable and closable.

The spray chamber and the load-lock chamber may each include an atmospheric pressure environment, a nitrogen ($N_2$) environment, or a vacuum environment.

A precursor solution, which is injected into the spray nozzle unit, may contain ammonium acetate ($CH_3CO_2NH_4$).

The spray coater may further include a precursor refining unit configured to refine a precursor used for spray coating.

The precursor may be a nitride-based precursor ($M(NO_3)$), an acetylacetonate-based precursor ($M(CH_3COCH_2COCH_3)$), or an acetate-based precursor ($M(CH_3COO^-)$), or ammonium acetate may be added to the precursor.

Here, M is an abbreviation of metal and includes one or more selected from a group consisting of In, Zn, Ga, and Tin.

A concentration of the precursor may be 0.2 M or less.

The spray coater may further include a plasma treatment unit disposed adjacent to the load-lock chamber and configured to perform $UV/O_3$ or $Ar/O_2$ plasma treatment.

A thin-film transistor for an oxide semiconductor according to another embodiment may be manufactured by using the spray coater.

The manufactured oxide semiconductor thin-film transistor may contain at least one of IGZO (Indium Gallium Zinc Oxide), IGTO (Indium Gallium Tin Oxide), ITZO (Indium Tin Zinc Oxide), IGZTO (Indium Gallium Zinc Tin Oxide), and IGO (Indium Gallium Oxide).

In the manufactured oxide semiconductor thin-film transistor, an oxide insulating layer containing at least one of $SiO_2$ (Silicon Dioxide), SiNx (Silicon Nitride), ZrOx (Zirconium Oxide), AlOx (Aluminum Oxide), and ZrAlOx (Zirconium Aluminum Oxide) is used as a gate insulating layer or a TFT (Thin-Film Transistor) protective layer.

A method of manufacturing a thin film according to still another embodiment may manufacture a ferroelectric HZO (HfZrO) (Hafnium Zirconium Oxide) thin film or a ZrOx (Zirconium Oxide), AlOx (Aluminum Oxide), and ferroelectric ZrOx/HZO/AlOx thin film by using the spray coater.

The spray coater according to the embodiments may load and unload a target substrate by using an automatic control method by using the robot arm.

In addition, the spray coater may have the plurality of spray chambers, and the plurality of spray chambers may independently perform the coating processes, such that the spray coater may sequentially form the plurality of films on the target substrate by using the plurality of materials.

DETAILED DESCRIPTION OF THE EMBODIMENTS

Figure 1:
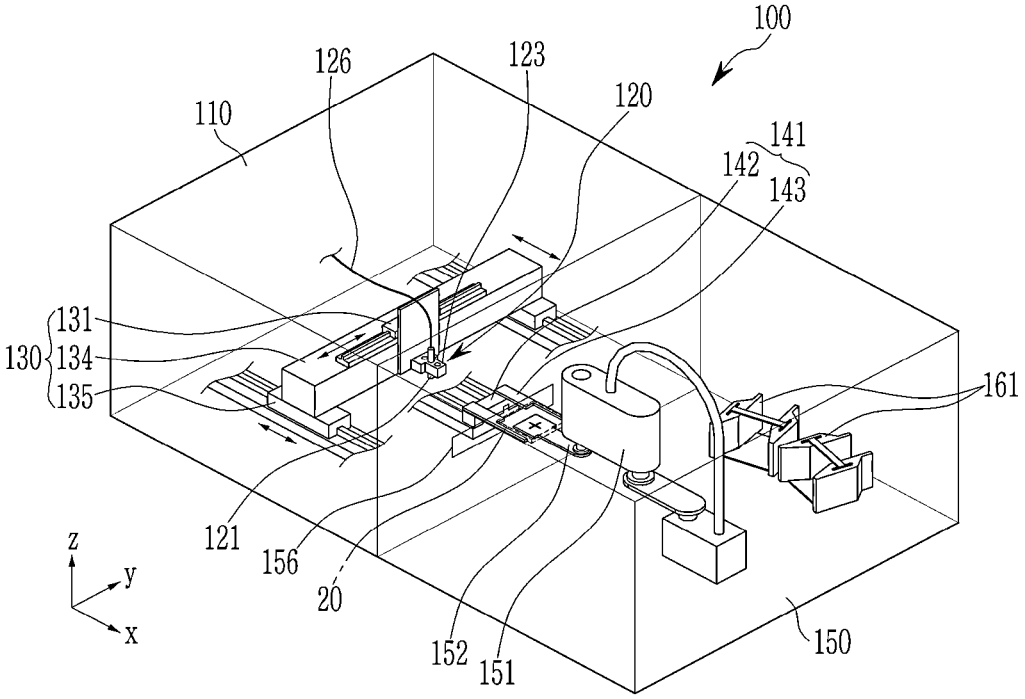
FIG. 1 is a perspective view schematically illustrating a spray coater according to an embodiment.

Hereinafter, embodiments of the present invention will be described in detail with reference to the accompanying drawings so that those with ordinary skill in the art to which the present invention pertains may easily carry out the embodiments. In the drawings, a part irrelevant to the description will be omitted to clearly describe the present invention, and the same or similar constituent elements will be designated by the same reference numerals throughout the specification. Some constituent elements in the accompanying drawings are illustrated in an exaggerated or schematic form or are omitted. A size of each constituent element does not entirely reflect an actual size.

In addition, it should be interpreted that the accompanying drawings are provided only to allow those skilled in the art to easily understand the embodiments disclosed in the present specification, and the technical spirit disclosed in the present specification is not limited by the accompanying drawings, and includes all alterations, equivalents, and alternatives that are included in the spirit and the technical scope of the present invention.

The terms including ordinal numbers such as 'first', 'second', and the like may be used to describe various constituent elements, but the constituent elements are not limited by the terms. These terms are used only to distinguish one constituent element from another constituent element.

In addition, when one component such as a layer, a film, a region, or a plate is described as being positioned "above" or "on" another component, one component can be positioned "directly on" another component, and one component can also be positioned on another component with other components interposed therebetween. On the contrary, when one component is described as being positioned "directly on" another component, there is no component therebetween. In addition, when a component is described as being positioned "above" or "on" a reference part, the component may be positioned "above" or "below" the reference part, and this configuration does not necessarily mean that the component is positioned "above" or "on" the reference part in a direction opposite to gravity.

Throughout the specification, it should be understood the terms "comprises," "comprising," "includes," "including," "containing," "has," "having" or other variations thereof are inclusive and therefore specify the presence of stated features, integers, steps, operations, elements, components, or combinations thereof, but do not preclude the presence or addition of one or more other features, integers, steps, operations, elements, components, or combinations thereof. Therefore, unless explicitly described to the contrary, the word "comprise/include" and variations such as "comprises/includes" or "comprising/including" will be understood to imply the inclusion of stated elements, not the exclusion of any other elements.

In addition, throughout the specification, when one constituent element is referred to as being "connected to" another constituent element, one constituent element can be "directly connected to" the other constituent element, and one constituent element can also be "indirectly connected to," "physically connected to," or "electrically connected to" the other element with other elements therebetween. Further, the constituent elements are defined as different names according to positions or functions thereof, but the constituent elements may be integrated.

Figure 2:
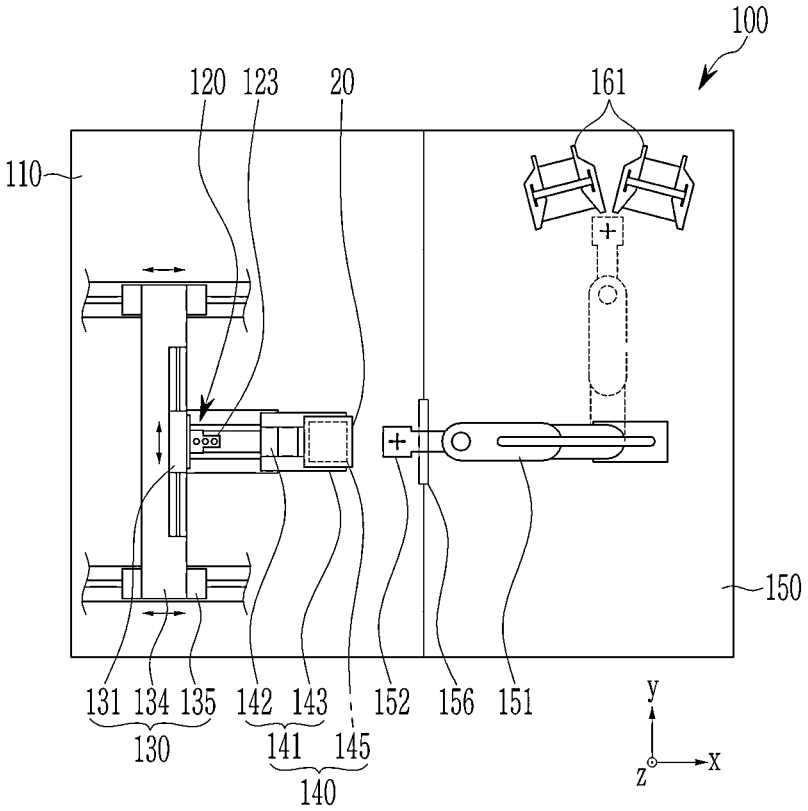
FIG. 2 is a top plan view schematically illustrating the spray coater according to the embodiment.
Figure 3:
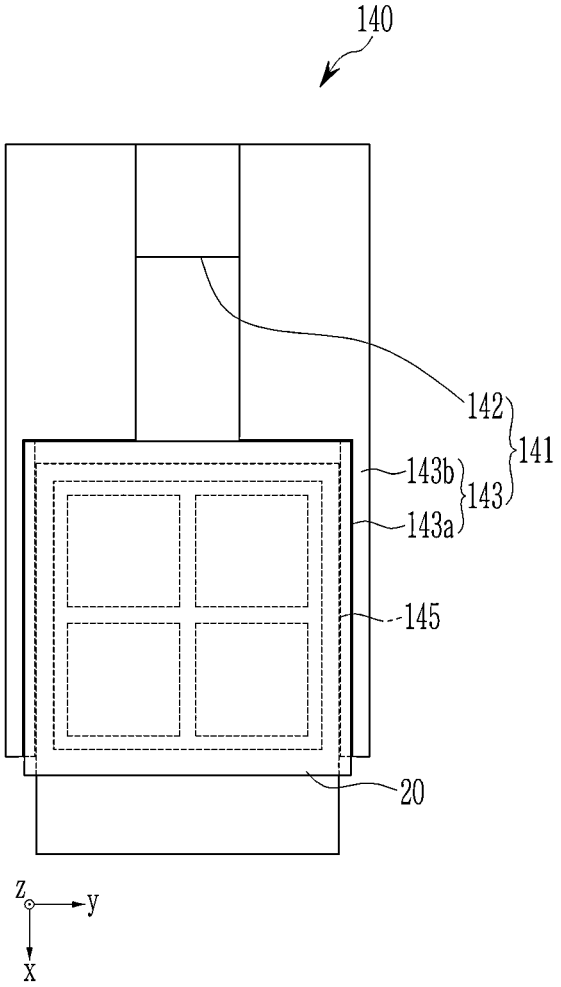
FIG. 3 is a top plan view illustrating a substrate seating unit of the spray coater according to the embodiment.

FIG. 1 is a perspective view schematically illustrating a spray coater according to an embodiment, FIG. 2 is a top plan view, and FIG. 3 is a top plan view illustrating a substrate seating unit of the spray coater.

Referring to FIGS. 1 and 2, a spray coater 100 according to the present embodiment includes a spray nozzle unit 120 configured to spray a coating material, a spray nozzle transfer unit 130 configured to control a position of the spray nozzle unit 120, and a substrate seating unit 140 positioned below the spray nozzle unit 120. The spray nozzle transfer unit 130 and the substrate seating unit 140 are mounted and installed on a base stage (not illustrated).

The spray nozzle unit 120 may have at least one spray nozzle 121, and the spray nozzle 121 may be inserted into and fixed to a nozzle holder 123. In addition, the spray nozzle 121 may be supplied with a coating material required for coating through a material supply pipe 126 connected to a coating material storage container (not illustrated).

The spray nozzle transfer unit 130 includes a first transfer block 131 on which the spray nozzle unit 120 is mounted. For example, the spray nozzle unit 120 may be mounted on the first transfer block 131 as the nozzle holder 123 is fixed to the first transfer block 131. The first transfer block 131 may be controlled to reciprocatingly move in a first direction (a y-axis direction in the drawings) along a guide rail provided on a second transfer block 134. In addition, the second transfer block 134 is elongated in the first direction, and third transfer blocks 135 are provided below two opposite ends of the second transfer block 134, respectively. Therefore, the second transfer block 134 may be controlled to reciprocatingly move in a second direction (an x-axis direction in the drawings) along guide rails provided on the base stage. Therefore, a position of the spray nozzle unit 120, which is required for the coating process, may be controlled as the spray nozzle unit 120 is operated at least in a planar direction (on a x-y plane in the drawings) by the transfer blocks 131, 134, and 135. In addition, the spray nozzle unit 120 may be moved in a vertical direction (a z-axis direction in the drawings) by a user, such that a distance between the substrate 20 and the spray nozzle 121 may be optionally adjusted.

The substrate seating unit 140 may be configured such that a substrate 20, which is subjected to the coating, is seated on the substrate seating unit 140 and disposed below the spray nozzle unit 120. In this case, the substrate 20 may be a glass substrate. As another example, all types of substrates, such as silicon wafer substrates and plastic substrates, which are applied to the spray process, may be applied. The substrate seating unit 140 may include a vertical movement holder 141 and a support plate 145 so that the substrate 20, which is subjected to the coating, is seated and supported below the spray nozzle unit 120. The vertical movement holder 141 may have a larger width than the substrate 20 and vertically move the substrate 20 by holding two opposite sides of the substrate 20. The support plate 145 may be configured as a heating plate further including a temperature control means to control a temperature thereof to a necessary temperature. The support plate 145 may support the substrate 20 during the spray process. The support plate 145, which is configured as the heating plate, may be controlled within a temperature range from a room temperature up to 600° C. at most, for example. The temperature of the substrate 20 may be maintained at 300 to 500° C. during the spray coating in order to form a uniform thin film.

The vertical movement holder 141 may be configured to seat the substrate 20 on the support plate 145 or move the substrate 20 upward from the support plate 145 while moving upward or downward below the spray nozzle unit 120.

The vertical movement holder 141 may include a holder body 142 and a pair of holder arms 143 extending from the holder body 142. The holder body 142 is configured to be movable at least in the vertical direction (z-axis direction in the drawings) below the spray nozzle unit 120. The pair of holder arms 143 may be disposed outside two opposite edges of the support plate 145 and extend in a direction (x-axis direction in the drawings) parallel to the edges. In addition, the pair of holder arms 143 may each include a lower part support portion 143*a* configured to support a lower part of the substrate 20, and a lateral part support portion 143*b* configured to support a lateral part of the substrate 20.

Referring to FIG. 3, a y-axis direction width of the support plate 145 is smaller than a y-axis direction spacing distance between the lower part support portions 143*a* of the pair of holder arms 143, such that the pair of holder arms 143 may move upward or downward relative to the support plate 145. A y-axis direction width of the substrate 20 may be larger than the y-axis direction width of the support plate 145 and the y-axis direction spacing distance between the lower part support portions 143*a* of the pair of holder arms 143. The y-axis direction width of the substrate 20 may be smaller than a y-axis direction spacing distance between the lateral part support portions 143*b* of the pair of holder arms 143. Therefore, when the pair of holder arms 143 passes by the support plate 145 in the z-axis direction in a state in which the substrate 20 is mounted on the pair of holder arms 143, the substrate 20 may be seated on the support plate 145.

In addition, the spray coater 100 according to the present embodiment may include a robot arm 151 configured to load the substrate 20 by moving the substrate 20 upward, and a substrate carrier 161 positioned at one side of the robot arm 151 and configured to accommodate the substrate 20.

For example, the robot arm 151 may include a horizontal articulated robot, i.e., a selective compliance assembly robot arm (SCARA). In general, the horizontal articulated robot may reach any point in a space while performing a single linear (vertical) motion and two rotational motions. That is, the robot arm 151 including the horizontal articulated robot may have two horizontal joint segments fixed to a base which is a vertical element, and a single linear vertical motion axis. Further, a handling strip 152 may be fixed to a distal end of the linear vertical motion axis of the robot arm 151 and move the substrate 20 upward or seat the substrate 20.

Therefore, the robot arm 151 may perform an operation of unloading the substrate 20 from the substrate carrier 161 and providing the substrate seating unit 140 with the substrate 20 before the substrate 20 is coated or an operation of unloading the substrate 20 from the substrate seating unit 140 and loading the substrate 20 on the substrate carrier 161 after the substrate 20 is coated. The substrate carrier 161 may accommodate the substrate 20 before the substrate 20 is coated or accommodate the substrate 20 after the substrate 20 is coated. The single substrate carrier 161 may selectively have different zones, and the substrate 20, which is to be coated, and the substrate 20, which has been coated, may be separately loaded on the single substrate carrier 161. Alternatively, the substrate 20, which is to be coated, and the substrate 20, which has been coated, may be separately loaded on a plurality of different substrate carriers 161.

Meanwhile, the spray coater 100, which has the above-mentioned components, may have a plurality of chambers separated from one another, and the components may be accommodated in the respective chambers.

For example, the spray coater 100 according to the present embodiment may include a spray chamber 110 and a load-lock chamber 150. The spray chamber 110 may accommodate the spray nozzle unit 120, the spray nozzle transfer unit 130, and the substrate seating unit 140. The robot arm 151 and the substrate carrier 161 may be accommodated together in the load-lock chamber 150.

In this case, the spray chamber 110 and the load-lock chamber 150 may be configured to communicate with each other through a chamber gate 156 which is openable and closable. For example, at the time of loading the substrate 20 by using the robot arm 151, the chamber gate 156 may be opened to allow the handling strip 152 of the robot arm 151 to enter or exist the load-lock chamber through the chamber gate 156. In this case, the chamber gate 156 may be controlled to be automatically opened or closed during the loading and unloading operations of the robot arm 151.

The spray chamber 110 and the load-lock chamber 150 may each include an atmospheric pressure environment or a vacuum environment. That is, both the spray chamber 110 and the load-lock chamber 150 may operate in the atmospheric pressure environment or the vacuum environment. In addition, the spray nozzle unit 120 may allow a precursor solution, which is to be injected, to include an ammonium acetate ($CH_3CO_2NH_4$) stabilizer.

Figure 4:
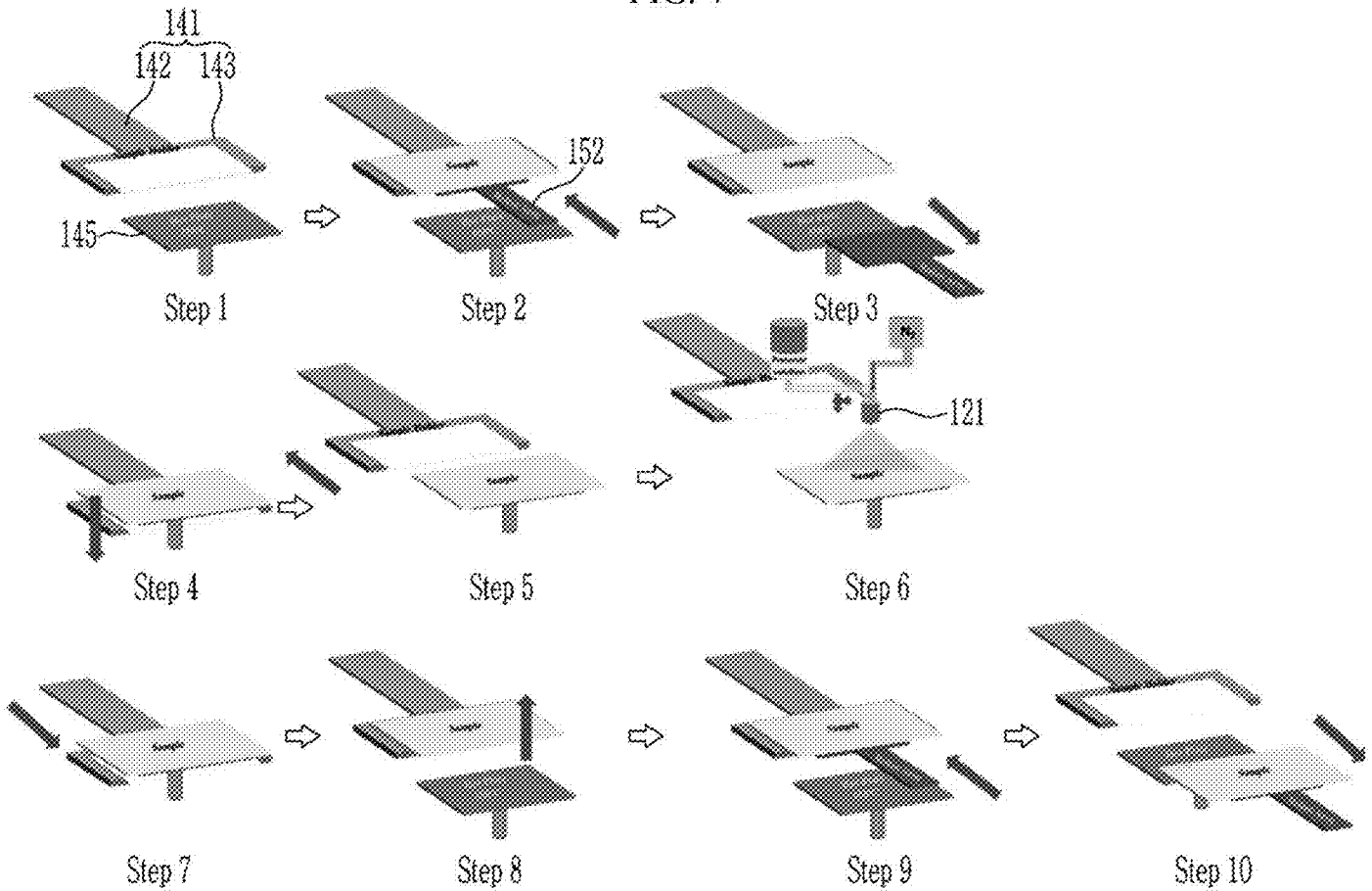
FIG. 4 is a perspective view schematically illustrating a process of operating the spray coater according to the embodiment for respective steps.

FIG. 4 is a perspective view schematically illustrating a process of operating the spray coater according to the embodiment for respective steps.

The vertical movement holder 141 may be positioned above the support plate 145, and the handling strip 152 of the robot arm 151 may transfer the substrate 20 while moving downward in the vertical direction from above the support plate 145, such that the substrate 20 may be placed on the holder arm 143 of the vertical movement holder 141 (see Steps 1 and 2 in FIG. 4).

Since the pair of holder arms 143 of the vertical movement holder 141 extends from two opposite sides of the holder body 142, a middle portion between the pair of holder arms 143 is vacant. Further, because the handling strip 152 of the robot arm 151 is configured as a narrow and long piece member, the handling strip 152 does not interfere with the pair of holder arms 143 between the pair of holder arms 143 and may separate from the pair of holder arms 143 after seating the substrate 20 on the holder arm 143 (see Step 3 in FIG. 4).

Therefore, the vertical movement holder 141, which receives the substrate 20, may seat the substrate 20 on the support plate 145 while moving downward in the vertical direction again so that the substrate 20 is supported on the support plate 145. Thereafter, when the vertical movement holder 141 continuously moves downward, the holder arm 143 moves further downward after passing by the support plate 145, and the substrate 20 may be kept in a state of being supported on the support plate 145 (see Steps 4 and 5 in FIG. 4).

The coating process may be performed as the spray nozzle 121 operates and moves to a position above the substrate 20 positioned on the support plate 145 moves. In this case, the vertical movement holder 141 may move further rearward from the support plate 145 so that the vertical movement holder 141 is not affected by the coating process. The spray nozzle 121 may spray the coating material in a state in which the temperature of the substrate 20 seated on the support plate 145 is raised by the support plate 145 (see Step 6 in FIG. 4).

After the substrate 20, which is completely coated, is subjected to preset curing or leveling, the vertical movement holder 141 enters again and moves upward to separate the substrate 20 from the support plate 145 (see Steps 7 and 8 in FIG. 4).

When the substrate 20 is separated from the support plate 145, the handling strip 152 of the robot arm 151 enters again and carries the substrate 20 from the holder arm 143 of the vertical movement holder 141 (see Steps 9 and 10 in FIG. 4).

Figure 5:
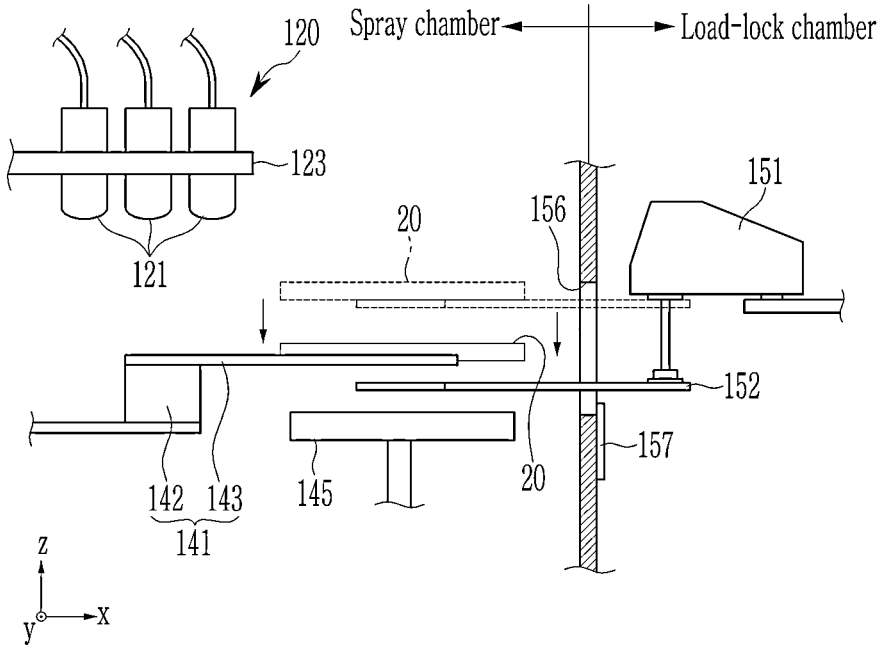
FIG. 5 is a side view schematically illustrating a process of operating the spray coater according to the embodiment.

FIG. 5 is a view schematically illustrating a process of operating the spray coater according to the embodiment. FIG. 5 illustrates a process of seating the substrate 20 on the vertical movement holder 141 by using the robot arm 151.

In the spray coater 100 according to the present embodiment, the robot arm 151 may load the substrate 20, which is subjected to the coating, from the substrate carrier 161 and transport the substrate 20 into the spray chamber 110. The load-lock chamber 150 and the spray chamber 110, which may accommodate the robot arm 151, are closed from each other and communicate with each other through the chamber gate 156. For example, a sliding door 157 may open or close the chamber gate 156 while being opened downward or closed upward.

Referring to FIG. 5, when the chamber gate 156 is opened as the sliding door 157 is opened, the handling strip 152 of the robot arm 151 may enter the spray chamber 110 through the chamber gate 156. In this case, the vertical movement holder 141 may be positioned below the handling strip 152 in the spray chamber 110, and the handling strip 152 of the robot arm 151 may transport the substrate 20 while moving downward in the vertical direction (z-axis direction in the drawings) so that the substrate 20 is placed on the holder arm 143 of the vertical movement holder 141.

Figure 6:
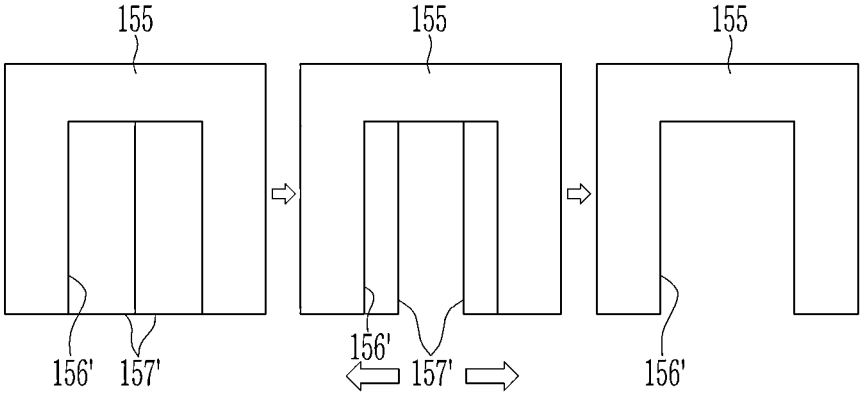
FIG. 6 is a front view illustrating a modified example of a chamber gate of the spray coater according to the embodiment.

FIG. 6 is a front view illustrating a modified example of the chamber gate of the spray coater according to the embodiment.

Referring to FIG. 6, in the present modified example, a chamber gate 156' is formed in a chamber wall 155 that separates the load-lock chamber 150 and the spray chamber 110. Left and right sliding doors 157', which may open or close the chamber gate 156' leftward and rightward, may be installed in the chamber gate 156'. The left and right sliding doors 157' may be controlled and opened or closed while operating in conjunction with the operation of the handling strip 152 of the robot arm 151.

Figure 7:
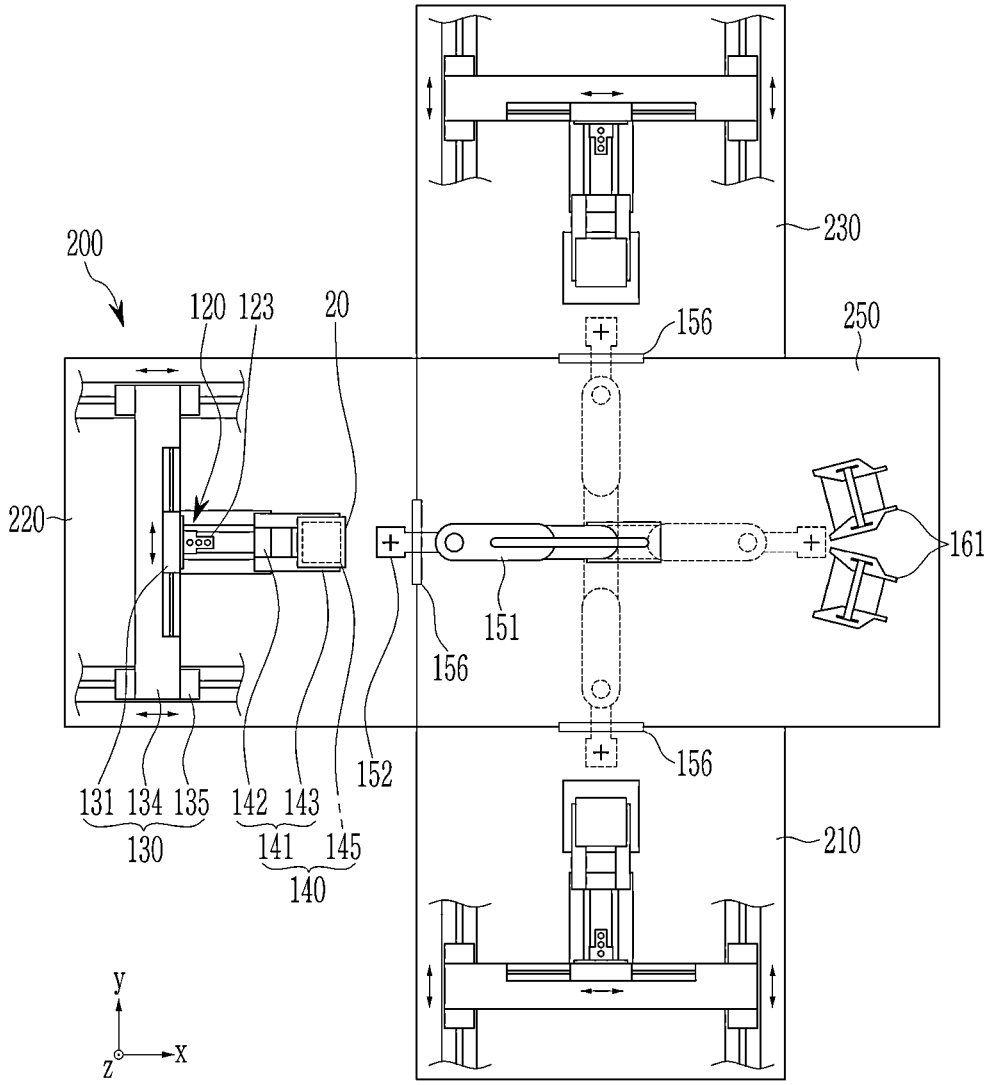
FIG. 7 is a top plan view schematically illustrating a spray coater according to another embodiment.

FIG. 7 is a top plan view schematically illustrating a spray coater according to another embodiment.

Referring to FIG. 7, a spray coater 200 according to the present embodiment may include spray chambers 210, 220, and 230, and a load-lock chamber 250. The spray chambers 210, 220, and 230 may include a plurality of sub-spray chambers 210, 220, and 230, for example, three sub-spray chambers 210, 220, and 230. The plurality of sub-spray chambers 210, 220, and 230 may be disposed adjacent to one another and closed from one another. Each of the plurality of sub-spray chambers 210, 220, and 230 may be configured to accommodate the spray nozzle unit 120, the spray nozzle transfer unit 130, and the substrate seating unit 140. Since the spray chambers include the plurality of sub-spray chambers disposed adjacent to one another as described above, the spray coater 200 according to the present embodiment may be configured as a cluster type spray coater.

The plurality of sub-spray chambers 210, 220, and 230 may be disposed adjacent to one another around the load-lock chamber 250. Further, the load-lock chamber 250, which accommodates the robot arm 151, may be configured to communicate with each of the plurality of sub-spray chambers 210, 220, and 230 through each of the chamber gates 156 which is openable or closable. Therefore, the handling strip 152 of the robot arm 151 may provide the substrate 20 to each of the sub-spray chambers 210, 220, and 230 or unload the substrate 20 from each of the sub-spray chambers 210, 220, and 230 while entering or existing through the each of the chamber gates 156.

For example, the plurality of sub-spray chambers 210, 220, and 230 may include the spray chamber 210 for a gate insulator, the spray chamber 220 for an oxide semiconductor, and a spray chamber 230 for passivation. For example, the spray chamber 210 for a gate insulator may include a configuration capable of depositing a gate insulator (GI) such as $SiO_2$, SiNx, ZrOx, AlOx, ZAO, LaZrO, and HfOx on the substrate 20. For example, the spray chamber 220 for an oxide semiconductor may include a configuration capable of depositing a semiconductor made of IGZO, IGTO, IZTO, ZnO, LaZnO, or InOx on the substrate 20. In addition, examples of passivation materials may selectively include $SiO_2$, SiNx, AlOx, ZrOx, AlOx/ZrOx, ZrOx/AlOx, and YOx.

Therefore, a multilayered thin film may be formed by performing the coating processes while sequentially loading and unloading the single substrate 20 to and from the plurality of sub-spray chambers 210, 220, and 230 by using the robot arm 151.

Figure 8:
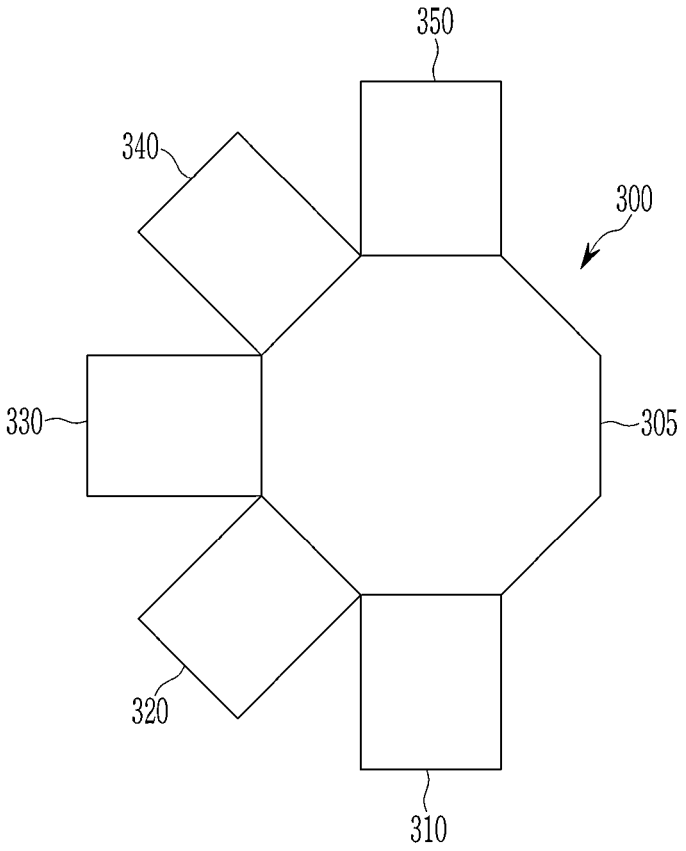
FIG. 8 is a top plan view schematically illustrating a spray coater according to still another embodiment.

FIG. 8 is a top plan view schematically illustrating a spray coater according to still another embodiment.

Referring to FIG. 8, a spray coater 300 according to the present embodiment may include a precursor refining unit 310, a plasma treatment unit 320, spray chambers 330, 340, and 350, and a load-lock chamber 305. In this case, the spray chambers 330, 340, and 350 may include a plurality of sub-spray chambers 330, 340, and 350, e.g., three sub-spray chambers 330, 340, and 350.

The precursor refining unit 310 may have a device for refining a precursor used for spray coating. The plasma treatment unit 320 may have a device for $UV/O_3$, $Ar/O_2$ plasma treatment. The plurality of sub-spray chambers 330, 340, and 350 may be disposed adjacent to one another and closed from one another. Each of the plurality of sub-spray chambers 330, 340, and 350 may be configured to accommodate the spray nozzle unit, the spray nozzle transfer unit, and the substrate seating unit. Since the precursor refining unit 310, the plasma treatment unit 320, and the sub-spray chambers 330, 340, and 350 are provided in the plurality of chambers disposed adjacent to one another as described above, the spray coater 300 according to the present embodiment may be configured as a cluster type spray coater.

The plasma treatment unit 320 and the plurality of sub-spray chambers 330, 340, and 350 may be disposed adjacent to one another with respect to the load-lock chamber 305. Further, the load-lock chamber 305, which accommodates the robot arm, may communicate with the plasma treatment unit 320 and the plurality of sub-spray chambers 330, 340, and 350 through chamber gates which is openable or closable. Therefore, the handling strip of the robot arm may provide the substrate to each of the plasma treatment unit 320 and the sub-spray chambers 330, 340, and 350 or unload the substrate from each of the plasma treatment unit 320 and the sub-spray chambers 330, 340, and 350 while entering or existing through each of the chamber gates.

When the spray coater 300 according to the present embodiment performs the spray coating, a nitride-based precursor ($M(NO_3)$), an acetylacetonate-based precursor ($M(CH_3COCH_2COCH_3)$), or an acetate-based precursor ($M(CH_3COO^-)$) may be used as the precursor (herein, M is an abbreviation of metal (e.g., In, Zn, Ga, Tin, etc.)), and ammonium acetate may be added to the precursor. The precursor may be refined by the precursor refining unit 310, and a concentration of the precursor to be injected into the nozzle to form a uniform thin film during the spray coating may be 0.2 M or less.

A thin-film transistor made of IGZO, IGTO, ITZO, IGZTO, or IGO may be manufactured by using the spray coater described above. In addition, the thin-film transistor may be manufactured by using an oxide insulating layer containing at least one of $SiO_2$, SiNx, ZrOx, AlOx, and ZrAlOx as a gate insulating layer or a TFT protective layer. In addition, ferroelectric HZO (HfZrO) thin films and ZrOx, AlOx and ferroelectric ZrOx/HZO/AlOx thin films may be manufactured by using the spray coater.

Hereinafter, a result of manufacturing a thin-film transistor (TFT) by using the spray coater according to the exemplary embodiment and measuring electrical properties of the thin-film transistor manufactured in this manner will be described in more detail. However, the protection scope of the present invention is not intended to be limited to the following examples.

Example 1 Manufacture of IGZO TFT

A bottom-gate top-contact IGZO TFT was manufactured by using the spray coater described with reference to FIG. 7. A molybdenum (Mo) film of 40 nm was deposited on a glass substrate by DC sputtering and patterned as a gate electrode. A zirconium oxide (ZrOx) thin film was deposited on a Mo backplane patterned by performing spin coating at 3500 rpm for 30 seconds. The thin film was cured for 5 minutes by a hotplate of 250° C. and then $UV/O_3$ treatment was performed for 200 seconds. A ZrOx film of 40 nm was obtained by repeating this process twice and then annealed in an air furnace at 350° C. for 2 hours.

The IGZO layer was deposited in the spray chamber 220 for an oxide semiconductor and deposited by spray pyrolysis on the heating plate at 350, 400, 425, or 450° C. An IGZO precursor solution of 0.1 M was sprayed for continuous 8 cycles to form the IGZO film of up to 12 nm. A distance between the spray nozzle and the substrate was kept as 10 cm and a spray flow velocity was about 3 ml/min. Photolithography patterning was performed after performing curing for 5 minutes and then wet etching was performed, thereby obtaining an active island.

Figure 9A:
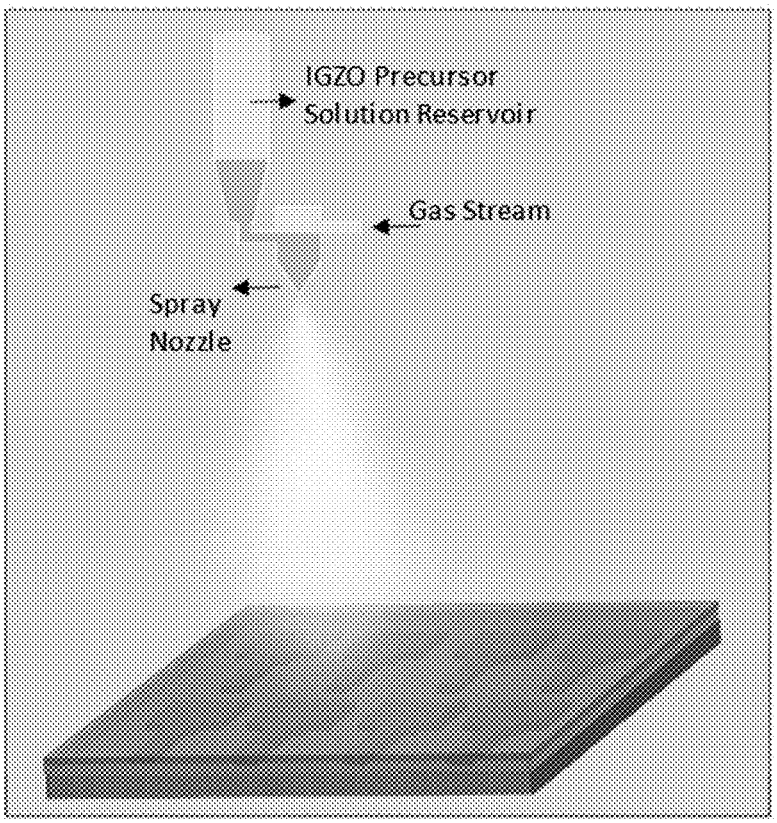
FIG. 9A is a schematic view illustrating a state in which an IGZO film is deposited by spray pyrolysis.
Figure 9B:
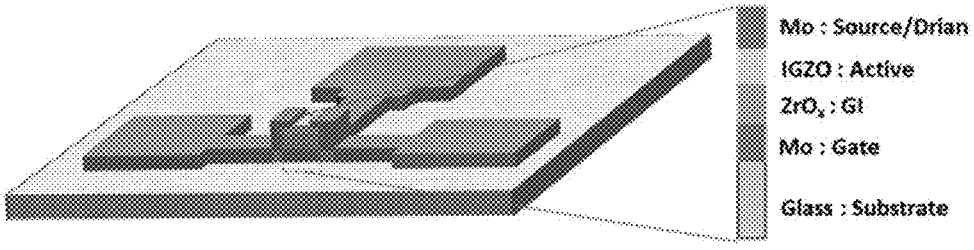
FIG. 9B is a schematic view illustrating a cross-section of a BG IGZO TFT.
Figure 9C:
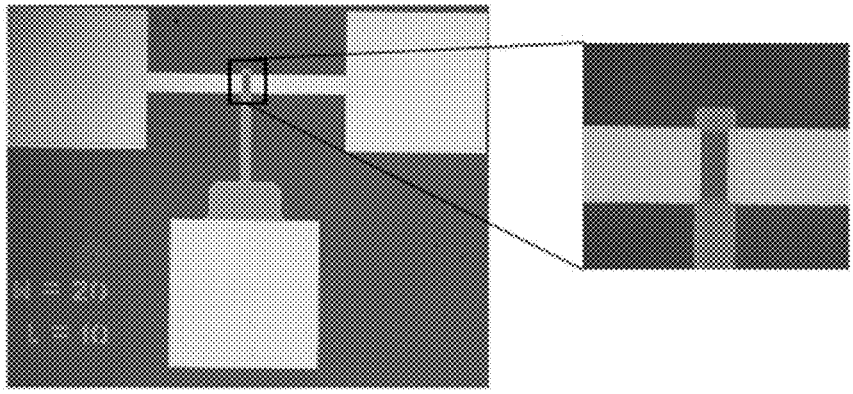
FIG. 9C is a view illustrating an optical image of a TFT having a channel width of 50 μm and a length of 10 μm after the TFT is manufactured.

After the active island was formed, patterning was performed by using a via hole and a gate contact pad was opened. A molybdenum (Mo) film of 40 nm was deposited by sputtering and patterned as a source/drain electrode on a gate insulator. A channel width/length ratio of 50 μm/10 μm was used for electrical characterization. To deposit the IGZO film without a coffee ring, the spray pyrolysis was performed on the heating plate at 350, 400, 425, or 450° C. FIG. 9A is a schematic view illustrating the deposition of the IGZO film by the spray pyrolysis. FIG. 9B is a cross-section schematic view of the BG IGZO TFT, and FIG. 9C illustrates optical images of the TFT after the TFT having a channel width of 50 μm and a length of 10 μm are manufactured.

Example 2 Measurement of Electrical Properties of IGZO TFT

An Agilent 4156C semiconductor parameter analyzer was used to measure electrical properties of the IGZO TFT manufactured in Example 1.

Table 1 shows statistics data including standard deviations related to electrical performance of 40 IGZO TFTs in the form of swing (SS) which is saturation mobility ($\mu_{sat}$), critical voltage ($V_{TH}$), and a critical value or less.

TABLE 1

| Deposition Temperature (° C.) | Saturation Mobility ($cm^2/Vs$) | SS (mV/dec) | $V_{TH}$ (V) | $I_{DS}$ (μA) |
|---|---|---|---|---|
| 350 | 8.50 ± 2.38 | 90 ± 6.65 | 1.74 ± 0.15 | 60 |
| 400 | 41.38 ± 2.78 | 85 ± 7.89 | 1.36 ± 0.18 | 230 |
| 425 | 55.58 ± 1.90 | 81 ± 6.75 | 0.3 ± 0.15 | 490 |
| 450 | 60.00 ± 1.75 | 85 ± 6.45 | 0.2 ± 0.08 | 508 |

Figure 10A:
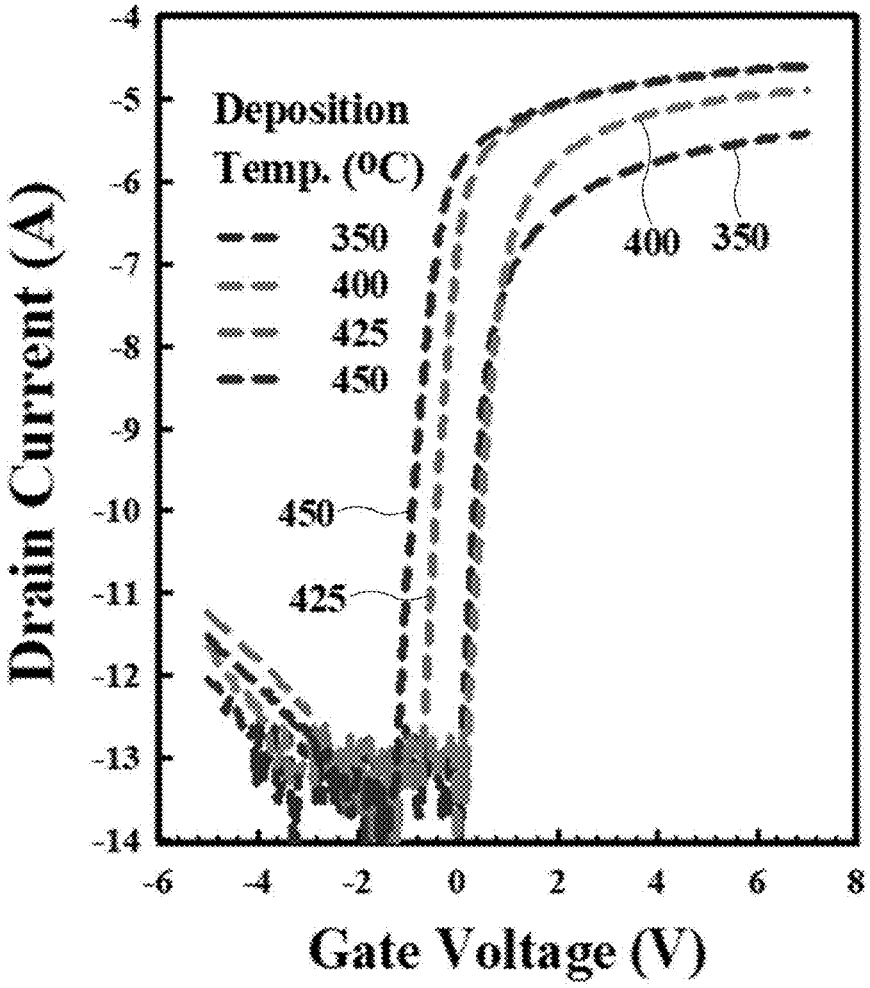
FIG. 10A is a view illustrating a transfer curve of an IGZO TFT having saturation mobility.
Figure 10B:
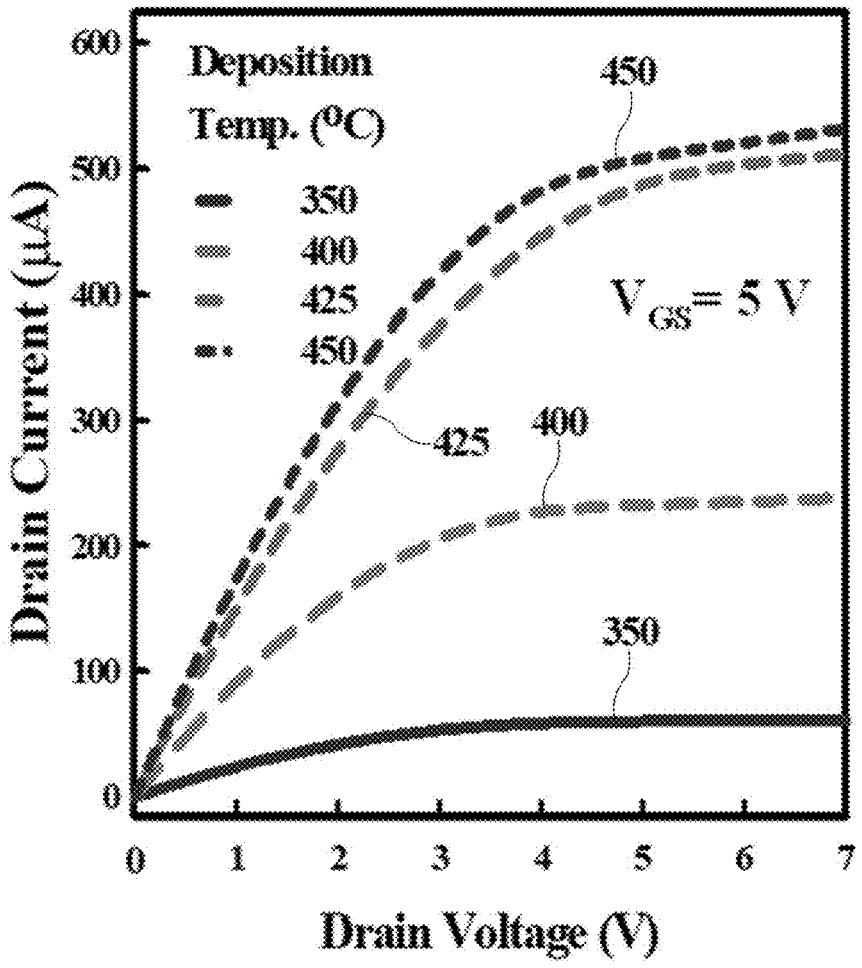
FIG. 10B is a view illustrating an output curve of the IGZO TFT.

FIG. 10A illustrates a transfer curve of an IGZO TFT having saturation mobility. Referring to Table 1 and FIG. 9A, the IGZO TFT deposited at 350° C. has saturation mobility ($\mu_{sat}$) of 8.50 $cm^2V^{-1}s^{-1}$, critical voltage ($V_{TH}$) of 1.74 V, and sub-critical value swing (SS) of 90 mV/dec. In contrast, the IGZO TFT deposited at 400, 425, or 450° C. has properties having $\mu_{sat}$ of 41.38, 55.58, and 60.00 $cm^2V^{-1}s^{-1}$, $V_{TH}$ of 1.36, 0.30, and 0.20 V, and SS of 85, 81, and 85 mV/dec. FIG. 10B illustrates an output curve of the IGZO TFT. The output curve shows clear pinch-off and saturation operations at low $V_{DS}$ without electric current pushing and this means excellent ohmic contact between the IGZO and the metal electrode (S/D). Drain currents in saturation regions ($V_{GS}$=5 V and $V_{DS}$=5 V) with respect to deposition temperatures (350, 400, 425, and 450° C.) were 60, 230, 490, and 508 μA, respectively, and $I_{on}/I_{off}$ was $10^7$, $10^8$, and $10^8$. As the deposition temperature increases, crystallinity of the IGZO thin film is improved, and higher mobility properties are exhibited.

Example 3 Manufacture of Ferroelectric TFT

A bottom-gate top-contact ferroelectric TFT was manufactured by using the spray coater described with reference to FIG. 7. A molybdenum (Mo) film of 40 nm was deposited on a glass substrate by DC sputtering and patterned as a gate electrode. A triple stack structure including zirconium oxide (ZrOx), hafnium zirconium oxide (HZO), and aluminum oxide (AlOx) was deposited for ferroelectric properties. The film was deposited in the spray chamber 210 for a gate insulator and deposited on a Mo backplane continuously patterned on the heating plate at 350° C. in the order of ZrOx of 5 nm, HZO of 30 nm, and AlOx of 5 nm. To form an optimized thickness, a ZrOx, AlOx precursor solution of 0.1 M was sprayed for continuous 2 cycles, and an HZO precursor solution of 0.1 M was sprayed for continuous 12 cycles. A distance between the spray nozzle and the substrate was kept as 12 cm and a spray flow velocity was about 3 ml/min. After the triple stack structure was deposited, rapid thermal annealing was performed at 650° C. for 3 minutes.

The ZnO layer was deposited in the spray chamber 220 for an oxide semiconductor and deposited by spray pyrolysis on the heating plate at 350° C. An ZnO precursor solution of 0.2 M was sprayed for continuous 6 cycles to form the ZnO film of 30 nm. A distance between the spray nozzle and the substrate was kept as 10 cm and a spray flow velocity was about 3 ml/min. Photolithography patterning was performed after performing curing for 5 minutes and then wet etching was performed, thereby obtaining an active island.

After the active island was formed, patterning was performed by using a via hole and a gate contact pad was opened. A molybdenum (Mo) film of 40 nm was deposited by sputtering and patterned as a source/drain electrode on a gate insulator.

Table 2 shows properties of the ferroelectric TFT having the triple stack structure (ZrOx/HZO/AlOx) with respect to channel lengths (3, 6, 8, and 10 μm) when a channel width is 20 μm. As the channel length increases by 3, 6, 8, and 10, the properties have pun of 75.18, 64.46, 73.22, and 73.66 $cm^2/Vs$, $V_{TH}$ of 0.05, 0.25, 0.25, and 0.4 V, and SS of 180, 190, 190, and 200 mV/dec. In addition, the properties of hysteresis (VH), which are properties of a memory window, have properties of 3.55, 2.75, 2.75, and 2.75 V.

TABLE 2

| Channel Length (μm) | Linear Mobility ($cm^2/Vs$) | SS (mV/dec.) | $V_{TH}$ (V) | $V_H$ (V) |
|---|---|---|---|---|
| 3 | 75.18 | 180 | −0.05 | 3.55 |
| 6 | 64.46 | 190 | 0.25 | 2.75 |
| 8 | 73.22 | 190 | 0.25 | 2.75 |
| 10 | 73.66 | 200 | 0.40 | 2.75 |

While the exemplary embodiments of the present invention have been described above, the present invention is not limited thereto, and various modifications can be made and carried out within the scope of the claims, the detailed description of the invention, and the accompanying drawings, and also fall within the scope of the invention.

DESCRIPTION OF SYMBOLS

100: Spray coater
110: Spray chamber
120: Spray nozzle unit
121: Spray nozzle
123: Nozzle holder
126: Material supply pipe
130: Spray nozzle transfer unit
131, 134, 135: First, second, and third transfer blocks
140: Substrate seating unit
141: Vertical movement holder
142: Holder body
143: Holder arm
145: Support plate
150: Load-lock chamber
151: Robot arm
152: Handling strip
156: Chamber gate
157: Sliding door
161: Substrate carrier
20: Substrate

What is claimed is:

1. A spray coater comprising:

a spray nozzle unit having at least one spray nozzle and configured to spray a coating material;

a spray nozzle transfer unit configured to control a position of the spray nozzle unit by operating a transfer block, on which the spray nozzle unit is mounted, at least in a planar direction;

a substrate seating unit positioned below the spray nozzle unit and configured such that a substrate, which is subjected to coating, is seated thereon, the substrate seating unit comprising a vertical movement holder configured to move the substrate in a vertical direction while moving upward or downward;

a substrate carrier configured to accommodate the substrate before the substrate is coated and accommodate the substrate after the substrate is coated; and a robot arm configured to unload the substrate from the substrate carrier and provide the substrate to the substrate seating unit before the substrate is coated or unload the substrate from the substrate seating unit and load the substrate on the substrate carrier after the substrate is coated, wherein the vertical movement holder comprises a holder body configured to move at least in the vertical direction below the spray nozzle unit, and a pair of holder arms extending from the holder body and configured to seat the substrate on the support plate or move the substrate upward, and wherein each of the pair of holder arms comprises a lower part support portion configured to support the lower part of the substrate, and a lateral part support portion configured to support a lateral part of the substrate.

2. The spray coater of claim 1, wherein the substrate seating unit further comprises a support plate configured to support a lower part of the substrate.

3. The spray coater of claim 2, wherein each of the pair of holder arms extends in a direction parallel to an edge of the support plate.

4. The spray coater of claim 1, wherein the pair of holder arms comprises a pair of lower part support portions, and a distance between the pair of lower part support portions is larger than a horizontal width of the support plate.

5. The spray coater of claim 2, further comprising:

a heating plate further comprising a temperature control means.

6. The spray coater of claim 5, wherein the heating plate is configured to maintain a temperature of the substrate within a range of 300 to 500° C.

7. The spray coater of claim 1, wherein the robot arm comprises a horizontal articulated robot.

8. The spray coater of claim 1, comprising:

a spray chamber configured to accommodate the spray nozzle unit, the spray nozzle transfer unit, and the substrate seating unit; and a load-lock chamber configured to accommodate the robot arm, wherein the spray chamber and the load-lock chamber communicate with each other through a chamber gate which is openable and closable.

9. The spray coater of claim 8, wherein the load-lock chamber is configured to accommodate the substrate carrier.

10. The spray coater of claim 8, wherein the spray chamber comprises a plurality of sub-spray chambers disposed adjacent to one another and closed from one another, and each of the plurality of sub-spray chambers is configured to accommodate the spray nozzle unit, the spray nozzle transfer unit, and the substrate seating unit.

11. The spray coater of claim 10, wherein each of the plurality of sub-spray chambers communicates with the load-lock chamber through a chamber gate which is openable and closable.

12. The spray coater of claim 8, wherein the spray chamber and the load-lock chamber each comprise an atmospheric pressure environment, a nitrogen ($N_2$) environment, or a vacuum environment.

13. The spray coater of claim 1, wherein a precursor solution, which is injected into the spray nozzle unit, contains ammonium acetate ($CH_3CO_2NH_4$).

14. The spray coater of claim 1, further comprising:

a precursor refining unit configured to refine a precursor used for spray coating.

15. The spray coater of claim 14, wherein the precursor is a nitride-based precursor ($M(NO_3)$), an acetylacetonate-based precursor ($M(CH_3COCH_2COCH_3)$), or an acetate-based precursor ($M(CH_3COO^-)$), or ammonium acetate is added to the precursor, wherein M is an abbreviation of metal and comprises one or more selected from a group consisting of In, Zn, Ga, and Tin.

16. The spray coater of claim 14, wherein a concentration of the precursor is 0.2 M or less.

17. The spray coater of claim 8, further comprising:

a plasma treatment unit disposed adjacent to the load-lock chamber and configured to perform $UV/O_3$ or $Ar/O_2$ plasma treatment.

18. An oxide semiconductor thin-film transistor manufactured by using the spray coater according to claim 1.

19. The oxide semiconductor thin-film transistor of claim 18, wherein the manufactured oxide semiconductor thin-film transistor contains at least one of IGZO (Indium Gallium Zinc Oxide), IGTO (Indium Gallium Tin Oxide), ITZO (Indium Tin Zinc Oxide), IGZTO (Indium Gallium Zinc Tin Oxide), and IGO (Indium Gallium Oxide).

20. The oxide semiconductor thin-film transistor of claim 18, wherein in the manufactured oxide semiconductor thin-film transistor, an oxide insulating layer containing at least one of $SiO_2$ (Silicon Dioxide), SiNx (Silicon Nitride), ZrOx (Zirconium Oxide), AlOx (Aluminum Oxide), and ZrAlOx (Zirconium Aluminum Oxide) is used as a gate insulating layer or a TFT (Thin-Film Transistor) protective layer.

21. A method of manufacturing a ferroelectric HZO (HfZrO) (Hafnium Zirconium Oxide) thin film or a ZrOx (Zirconium Oxide), AlOx (Aluminum Oxide), and ferroelectric ZrOx/HZO/AlOx thin film by using the spray coater according to claim 1.

* * * * *